US008910647B2

(12) United States Patent
Palo

(10) Patent No.: US 8,910,647 B2
(45) Date of Patent: Dec. 16, 2014

(54) TIP ASSEMBLY FOR MOBILITY DEVICES

(71) Applicant: Matti W. Palo, Covington, LA (US)

(72) Inventor: Matti W. Palo, Covington, LA (US)

( * ) Notice: Subject to any disclaimer, the term of this patent is extended or adjusted under 35 U.S.C. 154(b) by 0 days.

(21) Appl. No.: 14/168,384

(22) Filed: Jan. 30, 2014

(65) Prior Publication Data

US 2014/0209135 A1 Jul. 31, 2014

Related U.S. Application Data

(60) Provisional application No. 61/758,326, filed on Jan. 30, 2013.

(51) Int. Cl.
*A45B 9/04* (2006.01)
*A61H 3/02* (2006.01)

(52) U.S. Cl.
CPC ..... *A45B 9/04* (2013.01); *A61H 3/0288* (2013.01); *A61H 3/0277* (2013.01)
USPC ..... 135/82; 135/81; 135/86; 248/188.9

(58) Field of Classification Search
CPC ..... A45B 9/02; A45B 9/04; A61H 3/02; A61H 3/0288; A61H 3/0277; A61H 2003/0283
USPC ..... 135/65, 77–82, 84, 86; 248/156, 188.8, 248/188.9; 280/813, 819
See application file for complete search history.

(56) References Cited

U.S. PATENT DOCUMENTS

| | | | | | |
|---|---|---|---|---|---|
| 1,438,883 | A * | 12/1922 | Youngren | 135/83 |
| 2,116,941 | A * | 5/1938 | Francis | 135/78 |
| 2,606,568 | A * | 8/1952 | Walcot et al. | 135/80 |
| 3,177,884 | A * | 4/1965 | Thro | 135/77 |
| 3,448,749 | A * | 6/1969 | Stark | 135/70 |
| 6,216,713 | B1 * | 4/2001 | Kennan | 135/78 |
| 6,833,034 | B1 * | 12/2004 | Thomas, Jr. | 134/6 |
| 6,877,520 | B2 * | 4/2005 | Morris | 135/77 |
| 7,404,232 | B2 * | 7/2008 | Chase | 16/42 T |
| 8,720,459 | B2 * | 5/2014 | Moulton | 135/77 |
| 2010/0229903 | A1 * | 9/2010 | Ozuna et al. | 135/73 |

FOREIGN PATENT DOCUMENTS

| | | | | |
|---|---|---|---|---|
| DE | 102006027106 | * | 12/2007 | A45B 9/04 |
| JP | 2004290433 A | * | 10/2004 | A61H 3/06 |
| WO | WO 03005852 A1 | * | 1/2003 | A45B 9/04 |
| WO | WO 2006047804 A1 | * | 5/2006 | |

* cited by examiner

*Primary Examiner* — Winnie Yip
(74) *Attorney, Agent, or Firm* — Harness, Dickey & Pierce, PLC

(57) ABSTRACT

The present invention relates to a tip assembly for a mobility device such as a cane or walking stick, for example. The tip assembly including a specially shaped extension for enhanced gripping of the surface upon which the associated mobility device is being used. The tip assembly also generally includes a dampening element to assist in dissipating the reverberations of contacting the tip assembly with hard surfaces over time.

1 Claim, 3 Drawing Sheets

2
3
4
3
10

62
60
64
66
10
84
86
80
82
90
80A
44
22
24
20
34
26
30
28
32

FIG - 5
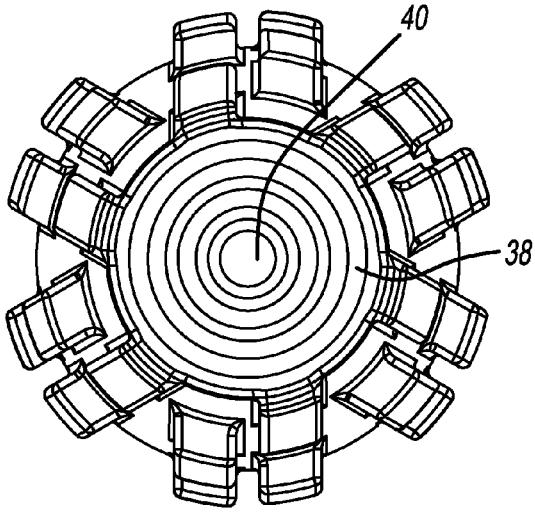
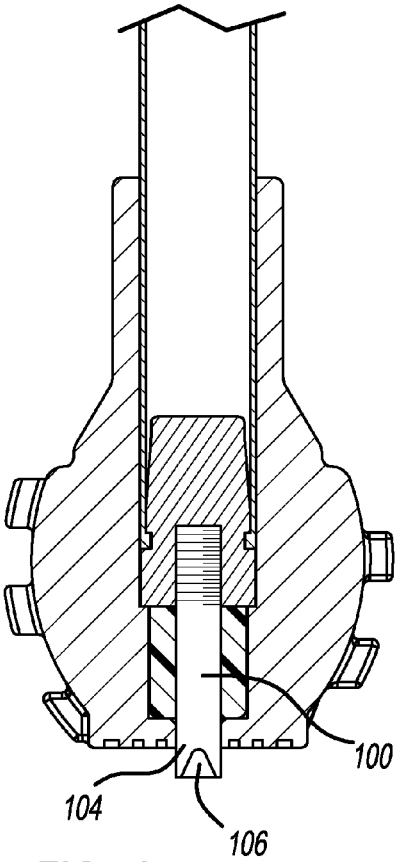
FIG - 6
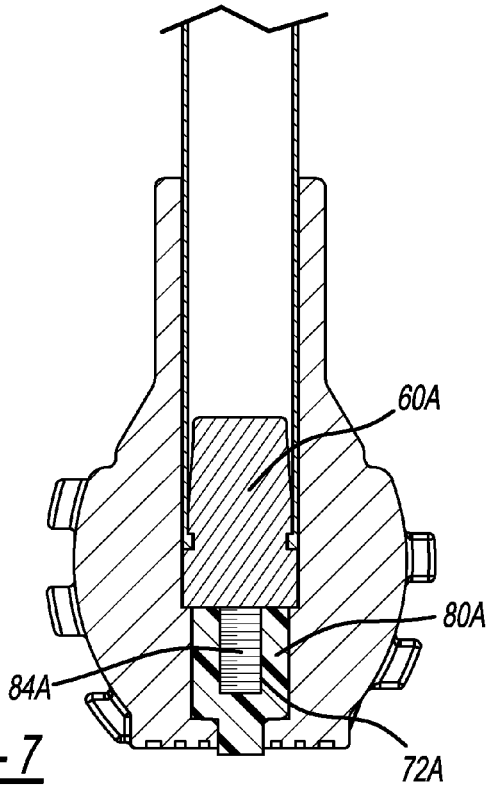
FIG - 7

TIP ASSEMBLY FOR MOBILITY DEVICES

CROSS-REFERENCE TO RELATED APPLICATIONS

This application claims the benefit of U.S. Provisional Application No. 61/758,326, filed on Jan. 30, 2013. The entire disclosure of the above application is incorporated herein by reference.

FIELD

The present disclosure relates to a tip assembly for mobility devices.

BACKGROUND

For hundreds of years ambulatory devices such as canes and walking sticks have been used to provide mobility to those suffering from chronic injury, cognitive disability or illness, as well as to prevent falls. Over time, the basic design of mobility assistance technology has changed very little, despite design issues that have been found to cause minor, or even sometimes, severe injury. In fact, thousands of elderly people are injured every year from cane or walker related falls, according to a Center for Disease Control and Prevention. In addition to falls, injuries have also been reported from repetitive strain or cumulative trauma disorder due to improper use and fit of canes. The medical costs of treating these types of injuries are estimated in the billions of dollars each year.

It is clear there is a great need for improved quality of life for the elderly and the temporarily or permanent injured who have compromised mobility.

Despite the artistic quality of many canes and walking sticks, the hard, slick handles, inability to adjust to the height and weight of the user and other design issues make them poor, ineffective choices for most long term users—if not outright dangerous to certain members of the population.

Evidence suggests the outdated design of most canes currently on the market are to blame for large instances of soft tissue damage from repetitive motion strain, injuries accrued from falls due to incorrect height of cane, slippery handle and/or base of cane, and poorly balanced weight of the walking device, which causes further impairment or injury.

Currently there are four basic types of mobility devices on the market that cater to the needs of the elderly or those temporarily or permanently disabled. These devices include the C-cane, functional grip canes, quad canes and hemi walkers.

The C-cane, which resembles a curved candy cane in shape, is the most common type of mobility device. These canes are available at a variety of retailers, including many pharmacies and drug stores, and are often chosen for use by people who have only a slight, temporary injury or walking impairment. C-canes generally feature a rubberized base that helps prevent slipping, but the simple design of the tips does not offer much in the way of balance control or for the reduction of repetitive stress or strain injury.

Functional grip canes are aptly named because the straight handle featured in this type of cane provides better balance capabilities to its users. However, aside from the improved grip, C-canes and functional grip canes are similar in every other fashion and fail to adequately prevent injuries to many.

The shape of the base in quad canes characterizes the biggest difference in design from both C-canes and functional grip canes. Rather than a rubberized point, these walking canes have a rectangular base, ending in four points. The points offer increased stability at the base of the cane, which is often an improvement for patients with longer-term injuries or impairments. Quads tend to be more durable than C-canes and functional grip canes.

Hemi-walker canes differ from quads in that their base is much larger. These canes are often utilized by people moving from a walker to a cane. Hemi walkers are commonly used by people suffering from a permanent injury or condition that affects mobility.

Falls aren't the only danger represented by outdated cane technology. Repetitive strain injury, also known as repetitive stress injury, repetitive motion disorder or regional musculoskeletal disorder, is an injury of the musculoskeletal and nervous systems that may be caused by repetitive tasks, forceful exertions, vibrations, mechanical compression (pressing against hard surfaces) or sustained or awkward positions. It is well documented that chronic cane or crutch use leads to repetitive stress disorder such as tendinitis, carpal tunnel syndrome, and osteoarthritis. In addition many people with arthritis are already at risk of these problems due to inflamed joints. In most patients, the pain is in the arm, back, shoulders, wrists or hands. It is worse with activity and leads to increased weakness and lack of endurance.

Cumulative trauma disorders treatment usually includes rest from the activities that caused the problem or a change in work practices. Doctors may prescribe treatments such as a wrist split, anti-inflammatory medications, steroid injections, physical and/or occupational therapy, cold and hot baths or even surgery in advanced cases. By offering an improved technology such as that presented in accordance with the teachings of the present invention, it is believed that the need for the above outlined treatment regimens can be greatly reduced.

SUMMARY

In view of the foregoing background information, the present invention is intended to offer a design which (1) lowers risk of falls through improved traction and improved proprioception; and (2) decreases the magnitude of force transmission from the cane to the user, among other benefits.

Decreased risk of falls is provided by a combination of features such as improved traction through a wider footprint at the cane tip with a gradual inclination at the edges of the tip's circumference. This maintains more of the rubber tip in contact with the surface for a longer period of time.

Further, the spherical, nodular exterior surface increases the side surface area in a wider variety of surfaces. This results in decreased slippage with better "grip" in a variety of surfaces such as mud, gravel, sand, and snow, for example. The user configurable design gives the ability to add even greater traction with the addition of specifically designed anchors. For example, under one embodiment, the anchor includes a pointed end which can penetrate ice or be used on gravel laden surfaces or while hiking, for example. The anchors are preferably formed from a hardened material, such as a carbide material.

Proprioception is improved through the modularity and the substantially spherical surface of the tip body. For instance, if walking up stairs, the user could simultaneously "grip" the step and the riser of the next step by positioning the cane tip in the corner formed by the junction of the step and riser, thereby abutting the cane tip to both surfaces. Likewise, in walking in hilly or rocky terrain, the side nodules can help improve traction through simultaneous grip on multiple surfaces. The resultant improvement in proprioception can help prevent falls.

Likewise, force transmission reduction to the user's joints can be accomplished

The flat base of the tip body with a tapered transition to the nodular edge provides a longer ground contact before lift-off of the cane tip during walking as compared to standard cane tips. For instance when walking with a cane or other assistive device, the cane strikes the ground at an angle in front of the user. The angled surface where the treads meet the flat surface of the trekball allows for greater surface contact than would be encountered with a simple flat tip with no inclination or nodules.

Further, the cane tip assembly of the present invention has a built-in shock absorber, i.e., dampener. The dampener is formed of a softer material which acts to lessen the transfer of force to the bottom of the cane and ultimately to the user's wrist, forearm, elbow, arm, and shoulder. The softer material may be made of materials such as silicone, soft rubber of low durometer, plastic, or other suitably deformable materials.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 5 is a bottom view of the tip body;

FIG. 6 is a bottom view of the tip body demonstrating an alternative anchor attachment; and FIG. 7 is a bottom view of the tip body sharing the threaded engagement of the tip component in an alternative arrangement.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Figure 1:
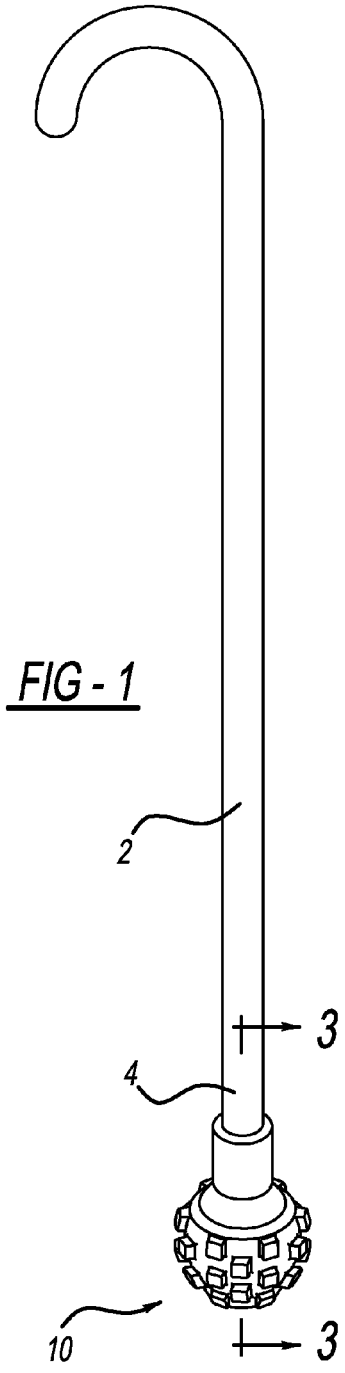
FIG. 1 is an assembled perspective view of the cane tip assembly of the present invention.
Figure 2:
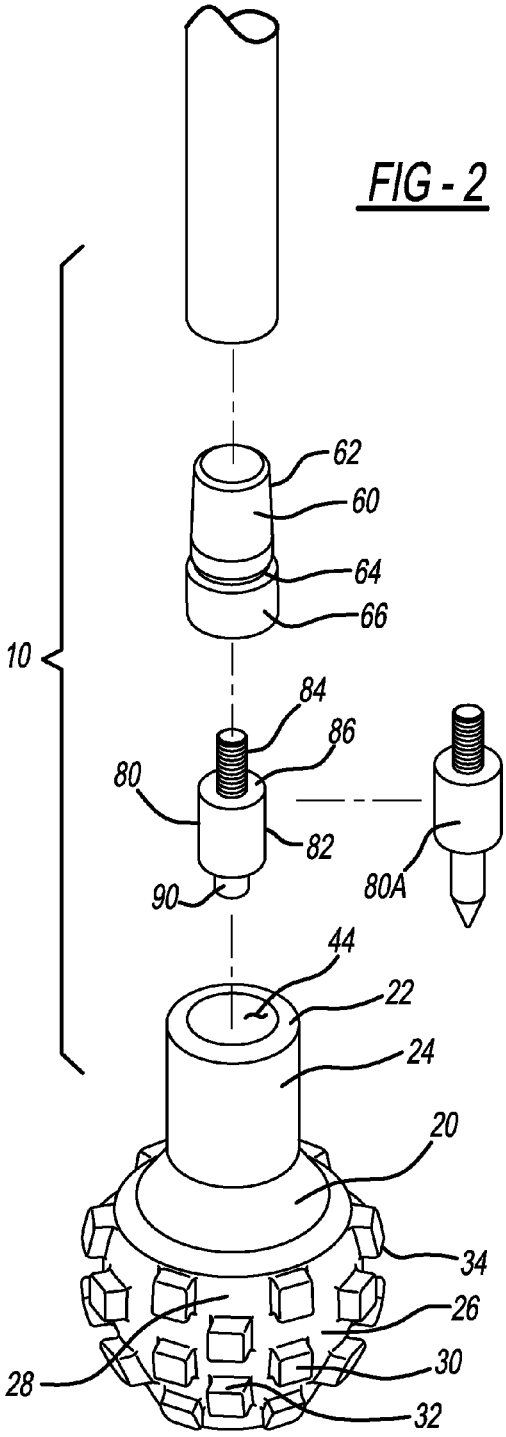
FIG. 2 is an exploded view showing the various components of the present invention.
Figure 3:
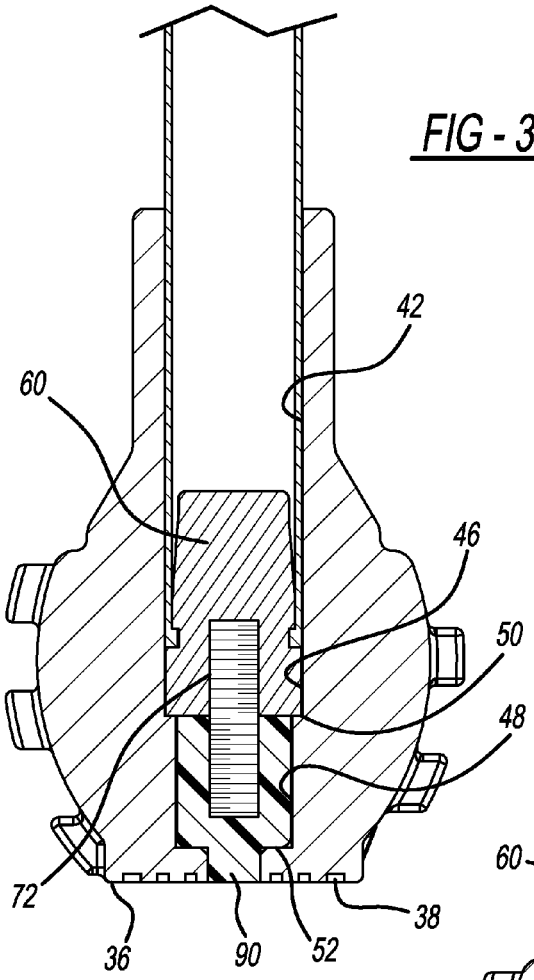
FIG. 3 is a cross-sectioned view of the tip assembly taken through line 3-3 of FIG. 1.

Referring to FIGS. 1-3 in particular, there is shown a tip assembly for a mobility device in accordance with the teachings of the present invention. By the phrase "mobility device", it is contemplated that the present invention can be used in association with a variety of ambulatory devices such as canes, walking sticks, crutches, walkers and other such devices.

The assembly includes the following major components, a tip body 20, a coupler 60 and a dampener 80. Optionally, depending on the intended use, the assembly may also include an anchor 100 integrated with the dampener.

The body 20 which is formed from a rubber or rubber-like material includes a hollow sleeve 24 along one end 22 which fits over the shaft 4 of the ambulatory device 2 demonstrated herein in the form of a C-cane. Extending from the sleeve is a substantially bulbous portion 26. While the sleeve fits securely over the end of the cane, it is contemplated that it and the tip itself may move slightly along the shaft during use. By allowing some movement along the shaft, the tip can better allow the dampener to more effectively stifle the force transmission from the surface to the user.

The bulbous portion 26, which is ball-like along the exterior wall 28, is provided with a plurality of spaced apart, outwardly extending protrusions 30 which serve to enhance gripping the surface upon which it is disposed. While the protrusions may have a variety of shapes and sizes, a currently preferred embodiment includes protrusions having sharp sidewalls 32 to give edges 34. The end 36 opposite the sleeve end, as best shown in FIG. 5, is generally flat and may include a series of recesses 38 shown here in the form of rings. The end 36 also includes an aperture 40. Internally, the body includes an inner diameter wall 42 defining a receptacle 44 for receiving the cane shaft 4, the coupler 60 and the dampener 80. The inner diameter wall 42 may receive the cane shaft in a substantially press fit relationship. Under at least one embodiment, the sleeve is intended to move slightly up and down the cane shaft as pressure is exerted upon the tip assembly and then released during use. If the tip assembly is intended to be permanently installed, an adhesive substance may be utilized between the inner wall and the cane shaft. The inner wall, as shown, has a first diameter 46 and a second reduced diameter portion 48. This, in turn, provides a first shelf 50 and a second shelf 52, respectively.

The second major component is a coupler 60. The coupler 60 is defined by a first substantially cylindrical portion 62 and a second, larger cylindrical portion 66. The first portion may have a slightly reduced diameter along the leading edge to facilitate insertion within the cane shaft. The indented transition portion 64, separating the two distinct cylindrical portions, serves to engage the inwardly projecting flange 6 occurring along the end wall 8 of the cane shaft. The first cylindrical portion plugs into the end of the cane shaft in a press fit relationship. The second cylindrical portion seats against the inner wall 42 of the tip body and the shelf 52. Occurring along the end of the coupler 60, according to the embodiment of FIGS. 1-5, is an internally threaded pocket 72. While not depicted, the size of the mating fastener can be larger than the pocket to force radial expansion of the second cylindrical portion. This will further secure attachment of the coupler within the receptacle of the tip body. The coupler 60 is typically formed from a rubber or thermoplastic-like material.

The third major component is referred to herein as a dampener 80. The dampener 80 is generally intended to provide the assembly with a shock absorbing feature. The dampener body 82 is formed from a material having a durometer hardness of less than about 70. By forming the dampener from a material which is generally softer than that of the tip body 20, the force transmission can be lessened as there is a buffer between the hard cane tip and the tip body.

The dampener 80 can be provided in differing durometers of hardness so that the overall assembly can be tailored to the surface conditions on which the ambulatory device is being used. In this regard, dampeners of differing durometers can be color coded to make it easier to select the appropriate dampener. These may be provided as a kit with different hardness depending on the weight of the user or the surface for ambulation. For instance, a lighter person may benefit more from a dampener with durometer 30 and a heavier person may benefit from a dampener of durometer 50. Under the embodiment depicted in FIGS. 1-5, the dampener includes a threaded stem 84 extending from a first end 86 which mates with the threaded pocket 72 of the coupler. Along the opposite end 88, the dampener may include a tab 90 which extends into the aperture 40.

Figure 4:
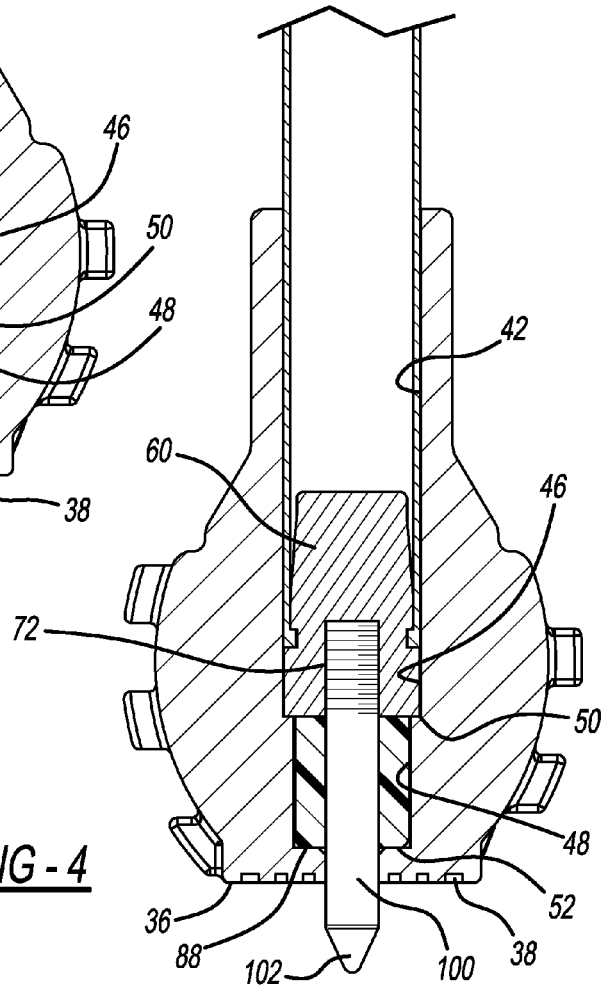
FIG. 4 is a cross-sectioned view of the tip assembly including an anchor attachment.

Under an alternative embodiment as shown best in FIG. 4, the dampener may include an anchor 100 to enhance contact with the surface on which the cane is to be utilized. In this case, the anchor 100 is generally an extension of stem 84 and projects beyond the end 88 and through the aperture 40 of the tip body. The anchor can be in the form of a sharpened spike 102 which can better penetrate surfaces covered with ice, for example. Other shapes, such as that shown in FIG. 6, depict the anchor in the form of a cylindrical stud 104 with or without a cut-out 106 shown. Referring to FIG. 7, an embodiment is provided wherein the threaded stem 84A is provided as part of the coupler 60A and the threaded pocket 72A is formed in the dampener 80A. It should therefore be understood by those of ordinary skill in the art that the mechanical fastening between the coupler of the dampener can come in different forms.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A tip assembly for a mobility device including a supporting shaft having a hollow end portion, said tip assembly comprising:

a tip body including a sleeve disposed over the supporting shaft and a bulbous portion extending from the sleeve, said bulbous portion having an outer surface including a plurality of outwardly extending protrusions and an inner wall defining a receptacle;

a coupler disposed within the receptacle including a first portion inserted into the supporting shaft and a second portion including a threaded pocket; and a dampener including a body formed from a material having a predetermined hardness capable of dissipating impact forces to the assembly and a threaded stem which is received by the threaded pocket.

* * * * *